United States Patent [19]

Cox

[11] 4,362,091

[45] Dec. 7, 1982

[54] AIR DEFLECTION DUCT ASSEMBLY

[75] Inventor: Howard W. Cox, Tempe, Ariz.

[73] Assignee: Mission Marketing Corp. of Arizona, Tempe, Ariz.

[21] Appl. No.: 253,596

[22] Filed: Apr. 13, 1981

[51] Int. Cl.[3] ..... F24F 7/06

[52] U.S. Cl. ..... 98/40 C; 62/299; 62/314; 98/116; 137/112; 137/512; 137/520

[58] Field of Search ..... 98/116, 40 C, 37, 39; 285/189, 424, DIG. 4, 158; 137/112, 512, 520, 521; 62/299, 314

[56] References Cited

U.S. PATENT DOCUMENTS

| | | | |
|---|---|---|---|
| 2,044,921 | 6/1936 | Swanland | 137/112 |
| 2,225,840 | 12/1940 | Newton | 137/520 X |
| 2,807,432 | 9/1957 | Parker et al. | 285/DIG. 4 |
| 2,963,783 | 12/1960 | Field | 285/424 X |
| 3,233,923 | 2/1966 | Raider et al. | 285/DIG. 4 |
| 3,908,751 | 9/1975 | Sheppard, Jr. | 137/112 X |
| 4,249,758 | 2/1981 | Harris | 285/158 |

FOREIGN PATENT DOCUMENTS

| | | | |
|---|---|---|---|
| 521857 | 8/1953 | Belgium | 98/116 |
| 2346080 | 3/1975 | Fed. Rep. of Germany | 285/424 |

*Primary Examiner*—William E. Tapolcai
*Attorney, Agent, or Firm*—LaValle D. Ptak

[57] ABSTRACT

An air deflection duct assembly is disclosed for use in adding an evaporative cooler unit to an existing refrigeration air conditioning duct to increase the efficiency of operation of the evaporative cooler by causing a higher percentage of the air flow from the cooler to pass into and through the existing refrigeration ducts. To accomplish this, first and second spaced apart duct assemblies are mounted over holes cut into the existing refrigeration air conditioning duct system. Each duct assembly has an adapter plate constructed with a circular hole in it, and this hole is normally closed by a pressure-opened deflector hinged at one edge of the hole. The hinged edges of the deflectors are mounted facing one another. When air is passed into the collar of the assembly extending upward from the hole from the evaporative cooler, the deflector plates open and extend at an angle into the existing refrigeration duct to deflect the air in opposite directions from the space between the openings cut in the duct. Thus, the evaporatively cooled air to moves into the preexisting refrigeration air conditioning duct in opposite directions from the installation of the first and second duct assemblies. This splitting of the air flow permits the attainment of a higher percentage of air flow from the evaporative cooler than is normally obtained in add-on or conversion installations of such equipment.

10 Claims, 6 Drawing Figures

FIG. 2
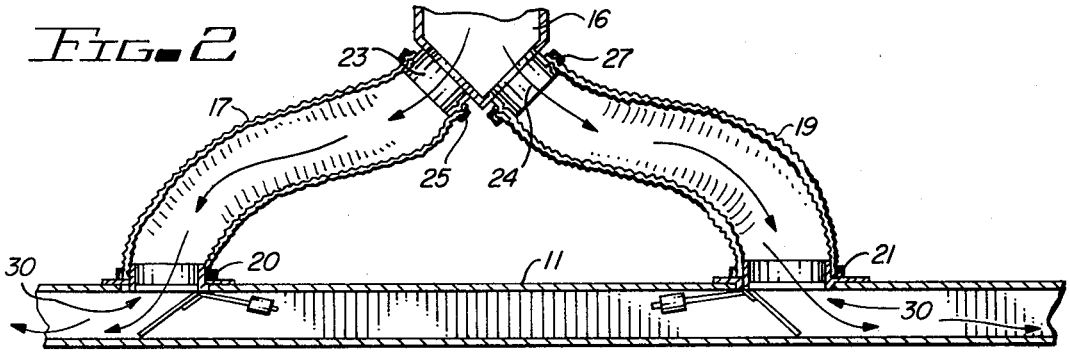
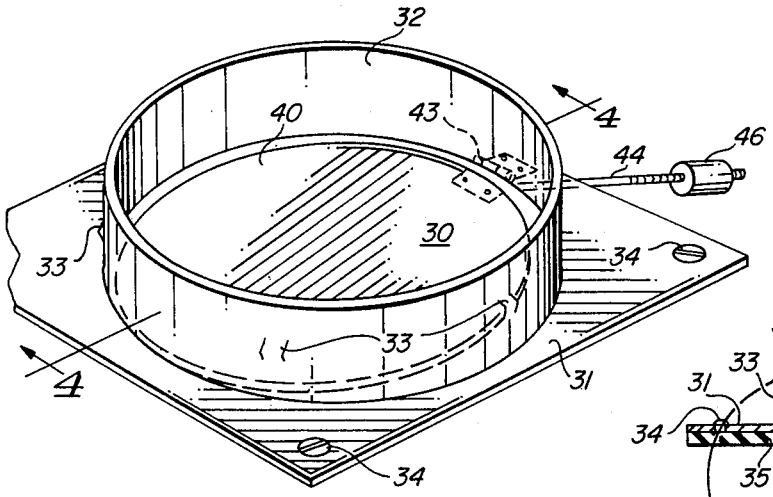
FIG. 3
FIG. 4
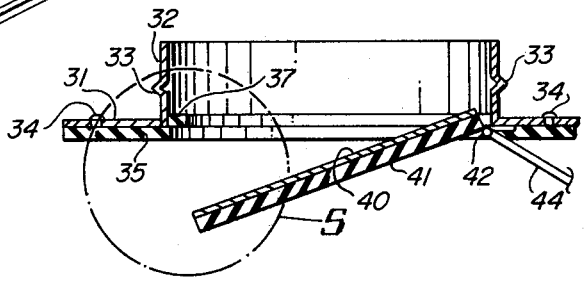
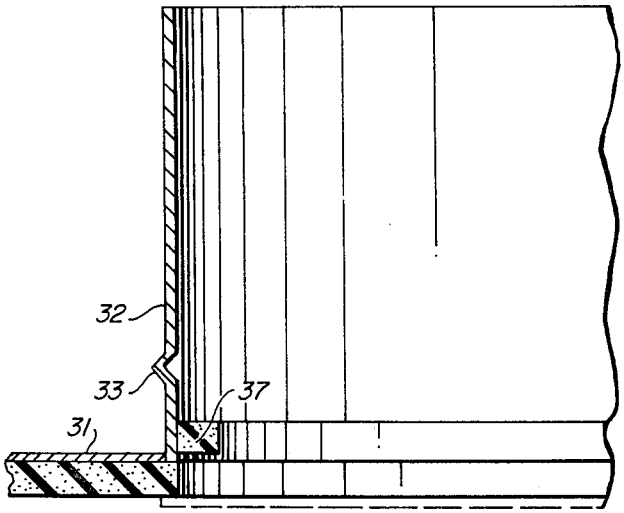
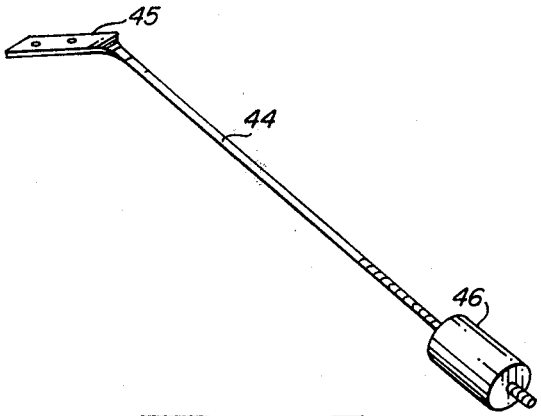
FIG. 6
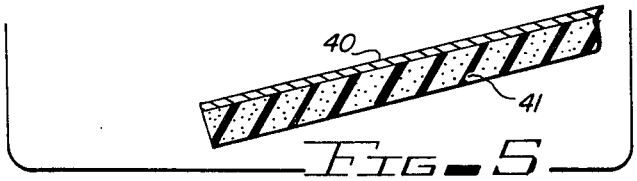
FIG. 5

AIR DEFLECTION DUCT ASSEMBLY

BACKGROUND OF THE INVENTION

In hot, dry climates such as the desert regions of the southwestern United States, evaporative cooling systems are widely used for cooling dwellings and other architectural structures. These cooling systems are popular because of their relatively low cost compared with refrigeration cooling or air conditioning systems. Evaporative coolers operate on the principle of the cooling effect provided when water evaporates from a saturated pad through which warm, dry air from outside the dwelling is passed into the dwelling under control of a fan or blower.

For most effective use of an evaporative cooler it is necessary to exhaust the air continuously from the building and to bring fresh air into the building through the evaporation pads of the cooler. In the U.S. Pat. No. to Cox, 4,047,475, assigned to the same assignee as this application, a ventilating damper assembly is disclosed for permitting the removal of air from the rooms of a dwelling through a damper assembly mounted in the ceiling of the room into which the cooled air is introduced by the evaporative cooler system. Typically, a ventilating damper of the type disclosed in the 4,047,475 patent is placed in the ceiling of each room to remove the air from the rooms and vent it into the attic of the building from which it passes outside through the conventional attic vents. Ventilating damper assemblies of the type disclosed in the 4,047,475 patent have met with widespread commercial success and result in improved efficiency of cooling operation with the evaporative cooler systems with which they are used.

Many homes, however, have preexisting refrigeration cooling or air conditioning systems in them, since when energy costs were low such systems generally were preferred over evaporative cooler systems. With the significantly increased energy costs which are prevalent throughout the United States today, however, the current trend in arid or semi-arid climates is back to evaporative cooling systems or a combination of evaporative cooling systems and refrigeration systems. In combination systems, the refrigeration cooling is only employed during the more humid months of the year, while the primary cooling of the dwelling is effected by the evaporative cooler. In preexisting installations, it has been common to install an evaporative cooler and connect the outlet duct from the cooler directly into an existing air conditioner duct. Appropriate dampers then are provided to switch the air flow between the refrigeration air conditioning unit or the evaporative cooler.

A problem is encountered in most such conversion installations, however, in that refrigeration air conditioning generally moves a much lower quantity of air per minute than an evaporative cooler; so that the air conditioning ducts in a home or other building originally built for refrigeration air conditioning are too small to adequately handle the double or triple amount of air movement required for evaporative cooler systems of the same or similar cooling capacity. For example, a five (5) ton refrigeration system cools air only at the rate of 2,000 cubic feet per minute, whereas an evaporative cooler of similar refrigeration capacity moves air at 4,500 cubic feet per minute up to 6,500 cubic feet per minute. If the duct work in the building is intended for the lower 2,000 cubic feet per minute air movement, the addition of a much higher capacity evaporative cooler blower for introducing air into such duct work overloads the carrying capacity of the duct work. This results in poor performance of the evaporative cooler system which is added into the refrigeration system.

In addition, the evaporative cooler typically is mounted on the roof of a building, and the interconnection to the existing duct work generally is a right-angle connection downwardly from the cooler into an opening cut into the top of a preexisting refrigeration duct. Consequently, the high volume air flow from the cooler impinges at right angles upon the opposite side of the preexisting duct. This results in a large amount of turbulance and back pressure; so that in some cases, very little air flow from the evaporative cooler actually takes place into and from the interconnection between the cooler outlet and the air conditioner duct input.

Consequently, it is desirable to provide improved operating results from conversion of refrigeration cooled systems to evaporatively cooled systems to overcome the shortcomings of previous systems. It further is desirable to overcome the disadvantages present in currently practiced conversion techniques at a minimum cost and in a simple and efficient manner.

SUMMARY OF THE INVENTION

It is an object of this invention to provide an improved duct assembly.

It is an additional object of this invention to provide an improved air deflection duct assembly.

It is another object of this invention to provide an improved deflection duct assembly for installation on an existing air duct.

It is a further object of this invention to provide an improved duct assembly for installation on an existing refrigeration air conditioning duct for permitting the use of such air conditioning duct with an evaporative cooler in a manner to obtain optimum operating efficiency from the evaporative cooler.

In accordance with a preferred embodiment of this invention, an air deflection duct assembly is constructed to permit its installation onto an existing air duct. This is accomplished by employing a first plate having an opening in it and made for attachment over an opening cut in an air duct to cooperate with the opening through the first plate. A collar is attached to the first plate around the periphery of the plate and extends upwardly above the opening. This collar permits interconnection of an air duct between the opening in the plate and an evaporative cooler. The opening in the plate normally is closed by a pressure-opened deflector; and when air flow into the collar of a preestablished pressure is present, the deflector opens to permit air to flow through the opening. The deflector then functions to deflect the air in a predetermined direction in the air duct on which the first plate is attached.

BRIEF DESCRIPTION OF THE DRAWINGS

FIG. 2 is a sectionalized view of the installation shown in FIG. 1;

FIG. 3 is a perspective view of a preferred embodiment of the invention;

FIG. 4 is a cross-sectional view taken along the line 4—4 of FIG. 3;

FIG. 5 is an enlarged view showing details of a portion of the structure shown in FIG. 4; and FIG. 6 is a detailed perspective view of a part used in the embodiment shown in FIG. 3.

DETAILED DESCRIPTION

Figure 1:
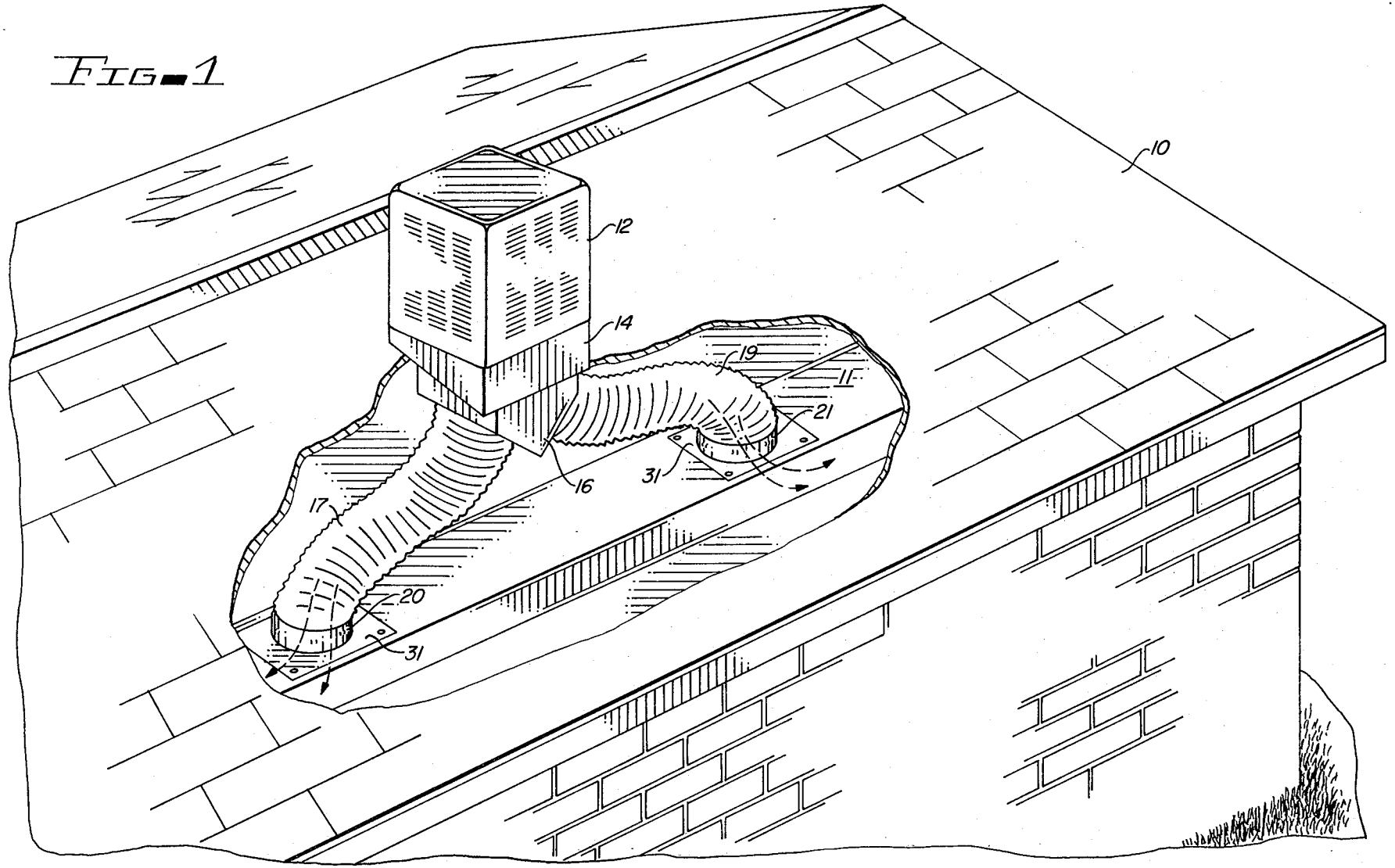
FIG. 1 is a partially cut-away perspective view illustrating the installation of a preferred embodiment of the invention in a dwelling or other building.

In the various Figures of the drawings, the same reference numbers are used to designate the same or similar components. Reference first should be made to FIG. 1 which illustrates a typical installation of a preferred embodiment of the invention. A home or other building 10 is shown having a preinstalled air conditioning or refrigeration cooling duct 11 extending along the ceiling of the rooms located within the building. Typically, this refrigeration duct is used to move air from an electric refrigeration unit (not shown) to outlets in the duct 11 located in various rooms of the dwelling. For a five (5) ton refrigeration system, the duct 11 typically is of a size to handle air movement of approximately 2,000 cubic feet per minute. To convert the cooling of the building 10 to an evaporatively cooled system, an evaporative cooler 12 of conventional construction is mounted on the roof. A mounting bracket 14, adapted to the pitch of the roof, is used to hold the unit 12 in proper orientation on the roof of the building 10. In accordance with a preferred embodiment of this invention, the air exiting from the bottom of the evaporative cooler 12 enters into a generally V-shaped discharge adapter 16 from which it is discharged in equal amounts through a pair of ducts 17 and 19 located on opposite sides of the adapter 16.

The discharge ends of the ducts 17 and 19 are connected to upwardly extending collars 32 (shown most clearly in FIGS. 2 through 5) located on the top of a pair of air deflection duct assemblies mounted over a pair of spaced holes cut in the top of the duct 11. The attachment of the assemblies 30 is effected by means of a plate 31 of each of the assemblies which are screwed into the top of the duct 11 by means of metal screws 34 (FIGS. 3 and 4).

The assembly described above is shown more clearly in the cross-sectional view of FIG. 2. The discharge adapter 16 has a pair of outwardly extending circular collars 23 and 24 located on opposite sides of the "V". The upper ends of the ducts 17 and 19 are slipped over these collars and are clamped in place by means of clamping rings 25 and 27. These clamping rings may be of any conventional suitable construction. Similarly, the lower ends of the ducts 17 and 19 are pushed over the outside of the collars 32 on the assemblies 30 and extend below a series of spaced dimples 33 formed about the periphery of the collars 32. Clamping rings 20 and 21 then are placed around the ends of the ducts 17 and 19 beneath the dimples 33 to hold the ducts 17 and 19 in place on the collars 32.

Reference to FIGS. 3, 4, and 5 illustrates the details of each of the deflection duct assemblies 30. A flat plate 31 is adapted to be placed over a rectangular hole cut in the top of a typical refrigeration air conditioning duct 11. Ideally, the hole cut in the duct 11 is a square hole slightly larger than the diameter of a circular opening formed in the plate 31 directly beneath the circular collar 32. The collar 32 is either integrally formed with the plate 31 or is separately formed and attached to the plate 31 about the periphery of the hole in the plate.

The underside of the plate 31 has a thin layer of resilient insulating material 35, typically foam insulation approximately one-quarter inch ($\frac{1}{4}$") thick, bonded to it. The insulation 35 is resilient and accommodates any undulations in the surface of the duct 11; so that when the screws 34, located at each of the four corners of the plate 31, are tightened to secure the plate 31 over the opening in the duct 11, the insulation 35 forms a tight seal all around the opening cut into the duct 11.

A resilient gasket 37 (shown most clearly in FIGS. 4 and 5) is bonded to the inner circumference of the collar 32 around its lower edge to form a relatively air-tight seal for a deflector plate 40, hingedly attached to the plate/collar assembly 31/32 by means of a hinge 43, illustrated most clearly in FIGS. 3 and 4. The deflector plate 40 and the mounting plate 31 preferably are made of conventional galvanized sheet material of the type commonly used in fabricating heating and air conditioning ducts. The circumference of the plate 40 is chosen to be slightly less than the circumference of the opening through the plate 31 at the bottom of the collar 32, but less than the inner circumference of the gasket 37; so that the plate 40 easily may move into and out of the opening as it pivots about the hinge 43.

A lever arm 44 is attached to the plate 40 at the point of attachment of the hinge 43 to the plate 40 by means of an extension 45, shown most clearly in FIG. 6. A weight 46 is internally threaded to mate with corresponding threads on the end of the rod 44 to permit adjustment of the weight 46 toward and away from the deflector plate 40. The weight 46 is moved to a position on the rod 44 to firmly close the deflection plate 40 against the gasket 37 when no air is supplied through either of the ducts 17 or 19 to the respective unit 30, thereby preventing movement of air out of the duct 11 into the ducts 17 and 19 when the evaporative cooler is not in use. To accomplish this, the length of the rod 44 and the angle between the rod 44 and the attachment portion 45 need to be selected so that when the deflection plate 40 is in the closed position, both the weight 46 and the end of the rod 44 clear the opposite side of the duct 11 (most clearly illustrated in FIG. 2).

The pressure applied to close the deflection plate 40 against the gasket 37 typically is selected to be only slightly more than the balancing pressure required; so that as soon as air is introduced into the ducts 17 or 19, the pressure of the moving air from the evaporative cooler 12 overcomes the bias provided by the weight 46 and pivots the deflection plate 40 downward to the position where its lower edge rests on the opposite side of the duct 11, as shown most clearly in FIG. 2. Also, as shown most clearly in FIG. 2, the hinged edges of the deflection plates 40 in the two units 30 attached respectively to the discharge ends of the ducts 17 and 19 face one another. Thus, the air is deflected in opposite directions into the duct 11 from each of the two units.

By splitting the air flow in the manner shown in FIG. 2, the substantially greater air flow produced by the evaporative cooler 12 and introduced into the refrigeration air duct 11 is split in half; so that only half of the total air flow goes in either direction into the ducts 11. In a typical installation, the location of the evaporative cooler 12 and the remainder of the assembly shown in FIG. 2 is selected to be somewhere near the center of the conventional refrigeration air duct system. As a result, if a 4,000 cubic foot per minute evaporative cooler is employed with duct work 11 originally made to operate with a 2,000 cubic foot per minute refrigeration unit, the splitting of the air flow provides a near perfect match since only 2,000 cubic feet of air moves in either direction from the two different air deflection duct assemblies which are employed with this system.

In addition, it should be noted, as shown most clearly in FIG. 2, the pressure of the incoming air on the deflection plates causes them to rest against the bottom edge of the ducts 11 at an angle which assists in diverting the air into the longitudinal dimensions of the ducts 11 in opposite directions from the region located between the two air deflection duct assemblies 30. If larger capacity evaporative coolers are used, the same relative improvement in the air flow movement is effected. Consequently, the system permits substantial performance improvement over the conventional approach of coming straight down from an evaporative cooler 12 into the duct 11 into a "T" interface. Such a standard approach creates a significant amount of turbulance at the point where the air moving downwardly from the cooler strikes the opposite or bottom side of the duct 11, and in many cases the result is that even less air flow takes place through the duct 11 for larger capacity evaporative coolers than when small capacity evaporative coolers are used. This problem is substantially reduced by means of the air deflection duct assemblies described above, particularly when they are installed in pairs, as illustrated in FIGS. 1 and 2, or in groups of three or more.

Ideally, the deflection plate 40 has a thin layer of foam insulation 41 (similar to the layer of insulation 35) bonded to its underside (the side facing the interior of the duct 11); so that when the plate 40 is in its closed position, and the duct 11 is used in conjunction with a conventional refrigeration unit, no significant heat loss takes place into the then unused ducts 17 and 19 through the deflection plates 40. It also should be noted that whenever the evaporative cooler is turned off or is inoperative, the weights 46 cause the deflection plates 40 to close the openings in the plates 31 thereby preventing the entrance of any hot air from outside. In addition, this operation automatically prepares the previously existingg air conditioning system for use in its normal manner. The home owner does not have to do anything whatsoever manually to effect the switchover since it takes place automatically simply by turning off the evaporative cooler. The weights 46 hold the deflection plates 40 in place against the gaskets 37 in the units 30 which are employed whenever the conventional refrigeration system is being operated to cool the building.

The foregoing description of the invention has been made in conjunction with the embodiment illustrated in the various Figures of the drawings. Changes and modifications will occur to those skilled in the art without departing from the scope of the invention. For example, instead of employing a deflection duct assembly having a circular opening and a circular deflection plate, it may be feasible to employ a square or rectangular opening instead, provided a proper interface can be made to a suitable duct 17 and 19 between the assembly and the outlets from the discharge adapter 16. In addition, it may be desirable in some cases to employ a spring instead of the weight 46 and lever arm 44 to bias the deflection plate or door 40 closed. Also, for extensive duct systems, three or more duct assemblies supplied from an appropriately modified discharge adapter 16 may be used. Other changes not specifically mentioned here also may occur to those skilled in the art without departing from the invention.

I claim:

1. An air deflection duct assembly including in combination:

a horizontal air duct having a top and a bottom;

first plate means for attachment to an opening in the top of said air duct and having a corresponding opening therethrough;

collar means attached to said plate means around the periphery of the opening therein and extending a predetermined distance above the opening;

normally closed, pressure-opened deflector means for closing the opening in said plate means and adapted to open at an angle into said air duct to which said first plate means is attached in response to air flow through said collar means to the opening to deflect air in a predetermined direction into said air duct to which said first plate means is attached, said deflector means extending across the inside of said duct at said angle to engage the bottom of said duct in response to such air flow; and means for biasing said deflector means closed with a predetermined force.

2. The combination according to claim 1 further including gasket means mounted on the inside of said collar means adjacent the opening in said plate means in a location to permit said deflector means to abut thereagainst when said deflector means closes the opening in said plate means.

3. The combination according to claim 1 wherein the opening in said first plate means is a circular opening and said pressure-opened deflector means comprises a circular plate hingedly attached to one of said first plate means and said collar means at the edge of the opening in said first plate means.

4. The combination according to claim 1 wherein said means for biasing said deflector means closed comprises a lever arm attached to said deflector means adjacent the hinge means and having a weight thereon extending from said plate means on the side opposite said collar means.

5. The combination according to claim 4 wherein said weight is positionally adjustable on said lever arm.

6. An air deflection duct assembly for adapting connection of an evaporative cooler to an existing refrigeration air conditioning duct including in combination:

a horizontal air duct having a top and a bottom;

first and second plate means for attachment to first and second spaced holes in the top of said air duct therein, said first plate means adapted for attachment over said first hole and having an opening therethrough in communication with such first hole and said second plate means for attachment over said second hole and having an opening therethrough for communication with such second hole;

first and second collar means attached, respectively, to said first and second plate means and extending around the peripheries of the openings in said first and second plate means to a predetermined distance above such openings; and first and second normally biased closed, pressure-opened deflector means for closing the openings in said respective first and second plate means and each adapted to open at an angle into said air duct to which said first and second plate means are attached in response to air flow through said first and second collar means, respectively, to the openings for deflecting air in said air duct in opposite directions away from the space between the first and second spaced holes therein.

7. The combination according to claim 6 further including insulation cushion means on the side of said first and second plate means opposite said collar means and including insulation means on the side of said first and second deflector means opposite said collar means.

8. The combination according to claim 6 further including first and second gasket means mounted on the inside of said first and second collar means adjacent the openings in said first and second plate means in a location to permit said corresponding first and second deflector means to abut thereagainst when said deflector means close the openings in said plate means.

9. The combination according to claim 6 wherein the openings in each of said first and second plate means are circular openings and said first and second pressure-opened deflector means each comprise a circular plate hingedly attached to the corresponding one of said plate means and said collar means at the edge of the opening in such corresponding plate means.

10. An air deflection duct assembly including in combination:

a horizontal air duct having a top and a bottom;

first plate means for attachment to an opening in the top of said air duct and having a corresponding opening therethrough;

collar means attached to said plate means around the periphery of the opening therein and extending a predetermined distance above the opening;

insulation cushion means on the side of said first plate means opposite said collar means;

normally closed, pressure-opened deflector means for closing the opening in said plate means and adapted to open at an angle into said air duct to which said first plate means is attached in response to air flow through said collar means to the opening to deflect air in a predetermined direction into said air duct to which said first plate means is attached; and insulation means on the side of said deflector means opposite said collar means.

* * * * *